US010801507B2

(12) United States Patent
Kabasawa

(10) Patent No.: US 10,801,507 B2
(45) Date of Patent: Oct. 13, 2020

(54) VACUUM PUMP, SPIRAL PLATE PROVIDED IN VACUUM PUMP, ROTATING CYLINDER AND METHOD FOR MANUFACTURING SPIRAL PLATE

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 16/341,646

(22) PCT Filed: Sep. 29, 2017

(86) PCT No.: PCT/JP2017/035472
§ 371 (c)(1),
(2) Date: Apr. 12, 2019

(87) PCT Pub. No.: WO2018/074190
PCT Pub. Date: Apr. 26, 2018

(65) Prior Publication Data

US 2019/0383293 A1 Dec. 19, 2019

(30) Foreign Application Priority Data

Oct. 20, 2016 (JP) ..... 2016-205842

(51) Int. Cl.
*F04D 29/40* (2006.01)
*F04D 17/16* (2006.01)

(52) U.S. Cl.
CPC ..... *F04D 17/168* (2013.01); *F04D 29/40* (2013.01); *F05D 2230/50* (2013.01); *F05D 2240/10* (2013.01); *F05D 2240/60* (2013.01)

(58) Field of Classification Search
None
See application file for complete search history.

(56) References Cited

U.S. PATENT DOCUMENTS 2,918,208 A 12/1959 Becker
2013/0209272 A1* 8/2013 Omori ..... F04D 29/5813 417/26

(Continued)

FOREIGN PATENT DOCUMENTS

EP 1850011 A2 10/2007
JP 2003013880 A 1/2003

(Continued)

OTHER PUBLICATIONS

PCT International Search Report dated Dec. 26, 2017 for corresponding PCT Application No. PCT/JP2017/035472.

(Continued)

*Primary Examiner* — Michael Lebentritt
(74) *Attorney, Agent, or Firm* — Theodore M. Magee; Westman, Champlin & Koehler, P.A.

(57) ABSTRACT

In a vacuum pump, a spiral plate on a downstream side of a slit is not disposed on an extended line of a spiral plate on an upstream side of the slit but is disposed after in a direction in which a gap formed by the slit is reduced. The distance by which the downstream spiral plate is moved corresponds to the distance in which the gap disappears and the upstream spiral plate and the downstream spiral plate overlap. When scraping the spiral plates, the radius of a machining end mill is set smaller than the width of the slit of the spiral plate, and the radius of the machining end mill is set smaller than the phase difference between the upstream spiral plate and the downstream spiral plate. In addition, end portions of the spiral plates between which the slit is formed are subjected to chamfering.

15 Claims, 7 Drawing Sheets

(56) References Cited

U.S. PATENT DOCUMENTS

| | | | | |
|---|---|---|---|---|
| 2015/0037137 | A1 | 2/2015 | Schofield et al. | |
| 2016/0069350 | A1* | 3/2016 | Nonaka | F04D 17/168 415/115 |
| 2016/0298645 | A1* | 10/2016 | Nonaka | F04D 19/046 |
| 2016/0319825 | A1* | 11/2016 | Nonaka | F04D 19/046 |
| 2017/0002832 | A1* | 1/2017 | Nonaka | F04D 29/584 |
| 2019/0249676 | A1* | 8/2019 | Kabasawa | F04D 29/541 |
| 2020/0025206 | A1* | 1/2020 | Kabasawa | F04D 19/04 |

FOREIGN PATENT DOCUMENTS

| | | | |
|---|---|---|---|
| JP | 2003269365 | A | 9/2003 |
| JP | 3135312 | U | 9/2007 |
| JP | 2015505012 | A | 2/2015 |

OTHER PUBLICATIONS

PCT International Written Opinion dated Dec. 26, 2017 for corresponding PCT Application No. PCT/JP2017/035472.

European Communication dated May 7, 2020 and Supplementary Search Report dated Apr. 24, 2020 for corresponding European Patent Application No. 17861325.3, dated May 7, 2020.

* cited by examiner

VACUUM PUMP, SPIRAL PLATE PROVIDED IN VACUUM PUMP, ROTATING CYLINDER AND METHOD FOR MANUFACTURING SPIRAL PLATE

CROSS-REFERENCE OF RELATED APPLICATION

This application is a Section 371 National Stage Application of International Application No. PCT/JP2017/035472, filed Sep. 29, 2017, which is incorporated by reference in its entirety and published as WO 2018/074190 A1 on Apr. 26, 2018 and which claims priority of Japanese Application No. 2016-205842, filed Oct. 20, 2016.

BACKGROUND

The invention relates to a vacuum pump, a spiral plate provided in the vacuum pump, a rotating cylinder, and a method for manufacturing the spiral plate.

Specifically, the invention relates to a vacuum pump including a spiral plate with slits, the spiral plate provided in the vacuum pump, a rotating cylinder, and a method for manufacturing the spiral plate.

A vacuum pump for carrying out vacuum exhaust processing in a vacuum chamber disposed therein houses a gas transfer mechanism which is a structure constituted by a rotor portion and a stator portion and providing an exhaust function.

Among such gas transfer mechanisms, there is a gas transfer mechanism that is configured to compress gas using an interaction between spiral plates disposed in the rotor portion and a stator disc disposed in the stator portion.

Japanese Translation of PCT Application No. 2015-505012 describes a structure in which spiral plates (such as the spiral blades 30) are installed on a side surface of a rotating cylinder of a vacuum pump, and stator discs (such as the perforated intersecting elements 14) provided with arrayed holes (such as the punched holes 38) are disposed in at least one slot 40 (a structure referred to as "slit" in the present application) provided in each of the spiral plates.

FIG. 6 and FIGS. 7A and 7B are each a schematic diagram for explaining the prior art.

As shown in FIG. 6, a stator disc 10 provided with the arrayed holes described above is disposed in a slit 9001 provided in each of spiral plates 9000 of the prior art, via the slit 9001 and a predetermined clearance (gap/space).

According to this structure, the spiral plates 9000 can be disposed in such a manner that the spiral shape continues from the inlet port (upstream) side to the outlet port (downstream) side, making machining in the manufacturing process easy.

The discussion above is merely provided for general background information and is not intended to be used as an aid in determining the scope of the claimed subject matter. The claimed subject matter is not limited to implementations that solve any or all disadvantages noted in the background.

SUMMARY

However, such a known vacuum pump with the spiral plates 9000 has the following problems.

As shown in FIG. 7A, in the spiral plates 9000 of the prior art, if an angle θ1 of each spiral plate 9000 is small, a gap would be created between an upstream spiral plate 9000 and a downstream spiral plate 9000, and the spiral plates 9000 (on the upstream side and the downstream side) do not share an overlapping part in the slit 9001 (gap C). Specifically, these spiral plates 9000 are not opposed to each other with a predetermined clearance therebetween.

According to this configuration, when the stator disc 10 with a solid portion 11 and a hole portion 12 is disposed in the slit 9001 between the spiral plates 9000, more gas flows backward through the spiral plates 9000 (the hole portion 12), as shown in FIG. 7B, possibly lowering the exhaust efficiency of the vacuum pump.

An object of the invention is to provide a vacuum pump designed to prevent gas from flowing backward, inhibit a decrease of exhaust efficiency and improve productivity, a spiral plate provided in the vacuum pump, a rotating cylinder, and a method for manufacturing the spiral plate.

The invention described in claim 1 provides a vacuum pump having: a housing in which an inlet port and an outlet port are formed; a rotating shaft enclosed in the housing and supported rotatably; spiral plates provided with at least one slit and disposed in a spiral form on an outer peripheral surface of the rotating shaft or of a rotating cylinder disposed on the rotating shaft; a stator disc disposed in the slit of each of the spiral plates, with a predetermined space from the slit, and having a hole portion penetrating the stator disc; a spacer for fixing the stator disc; and a vacuum exhaust mechanism for transferring gas sucked from the inlet port to the outlet port by an interaction between the spiral plates and the stator disc, wherein at least one of the spiral plates on a downstream side of the slit is disposed offset from an extended line of at least one of the spiral plates on an upstream side of the slit in a direction in which the spiral plate on the downstream side of the slit overlaps the spiral plate on the upstream side of the slit.

The invention described in claim 2 provides the vacuum pump according to claim 1, wherein the spiral plate on the upstream side and the spiral plate on the downstream side overlap each other with a predetermined gap therebetween in at least one of a plurality of the slits, and the slit becomes invisible in a direction of the rotating shaft.

The invention described in claim 3 provides the vacuum pump according to claim 1 or 2, wherein in at least one of a plurality of the slits, a phase difference between the spiral plate on the upstream side and the spiral plate on the downstream side is equivalent to a width of the slit.

The invention described in claim 4 provides the vacuum pump according to claim 1, 2 or 3, wherein at least one of acute angle portions formed by dividing the spiral plates by the slit is subjected to chamfering.

The invention described in claim 5 provides the vacuum pump according to claim 4, wherein the chamfering is performed within a width of a horizontal plane formed by dividing the spiral plates by the slit, and the chamfer has an acute angle.

The invention described in claim 6 provides the vacuum pump according to any one of claims 1 to 5, having the spiral plates cut by a cutting tool having a radius smaller than at least one of a width of the slit of each of the spiral plates and a phase difference between the spiral plate on the upstream side and the spiral plate on the downstream side.

The invention described in claim 7 provides a spiral plate which is provided in the vacuum pump described in any one of claims 1 to 6.

The invention described in claim 8 provides a rotating cylinder, having the spiral plate described in claim 7.

The invention described in claim 9 provides a method for manufacturing the spiral plate described in claim 7, the method having: a first step of cutting an inclined surface of the spiral plate on the downstream side; a second step of forming the chamfer on the spiral plate on the downstream side; and a third step of cutting an inclined surface of the spiral plate on the upstream side.

According to the invention, the configuration in which the spiral plate on the upstream side of the slit overlaps the spiral plate on the downstream side of the slit can reduce the possibility that gas flows backward from the gap between these spiral plates. Consequently, the exhaust efficiency of the vacuum pump provided with the spiral plates can be enhanced.

Further, the productivity of the vacuum pump can be improved by integrally machining the spiral plates.

The aspects of the invention described above can realize a vacuum pump having excellent exhaust performance at low cost.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENT

(i) Summary of Embodiment

A vacuum pump according to an embodiment of the invention has a configuration in which a spiral plate on a downstream side of a slit is not disposed on an extended line of a spiral plate on an upstream side of the slit but is disposed at a position moved toward the downstream side to reduce a gap formed by the slit.

The distance by which the downstream spiral plate is moved as described above corresponds to the distance in which the gap disappears and an overlapping part is created between the upstream spiral plate and the downstream spiral plate when the upstream spiral plate and the downstream spiral plate are projected on each other in an axial direction.

When machining (scraping) the spiral plates, it is desirable that the spiral plates be designed on the basis of at least one of the followings (1) and (2):

(1) The radius of a machining end mill is smaller than the width of the slit of the spiral plate; and (2) The radius of the machining end mill is smaller than the phase difference between the upstream spiral plate and the downstream spiral plate. Note that "phase difference" described in the present application does not mean an angular difference but a circumferential interval (distance) according to a positional relationship between the spiral plates.

In addition, at least one of acute angle portions divided by the slit of the spiral plate is subjected to chamfering.

According to the configuration described above, by disposing a stator disc having a hole portion in the slit of the spiral plate, the gas can be prevented from flowing backward through the slit of the spiral plate and the hole portion of the stator disc. Moreover, the productivity of the vacuum pump can be improved integrally machining the spiral plates by eliminating machining paths which are moving paths for a tool required for machining. The foregoing configuration can also reduce friction loss occurring between each spiral plate and the stator disc, making the gas flow smooth.

(ii) Details of Embodiment

A preferred embodiment of the invention is described hereinafter in detail with reference to FIG. 1 to FIGS. 5A to 5C.

Configuration of Vacuum Pump 1

Figure 1:
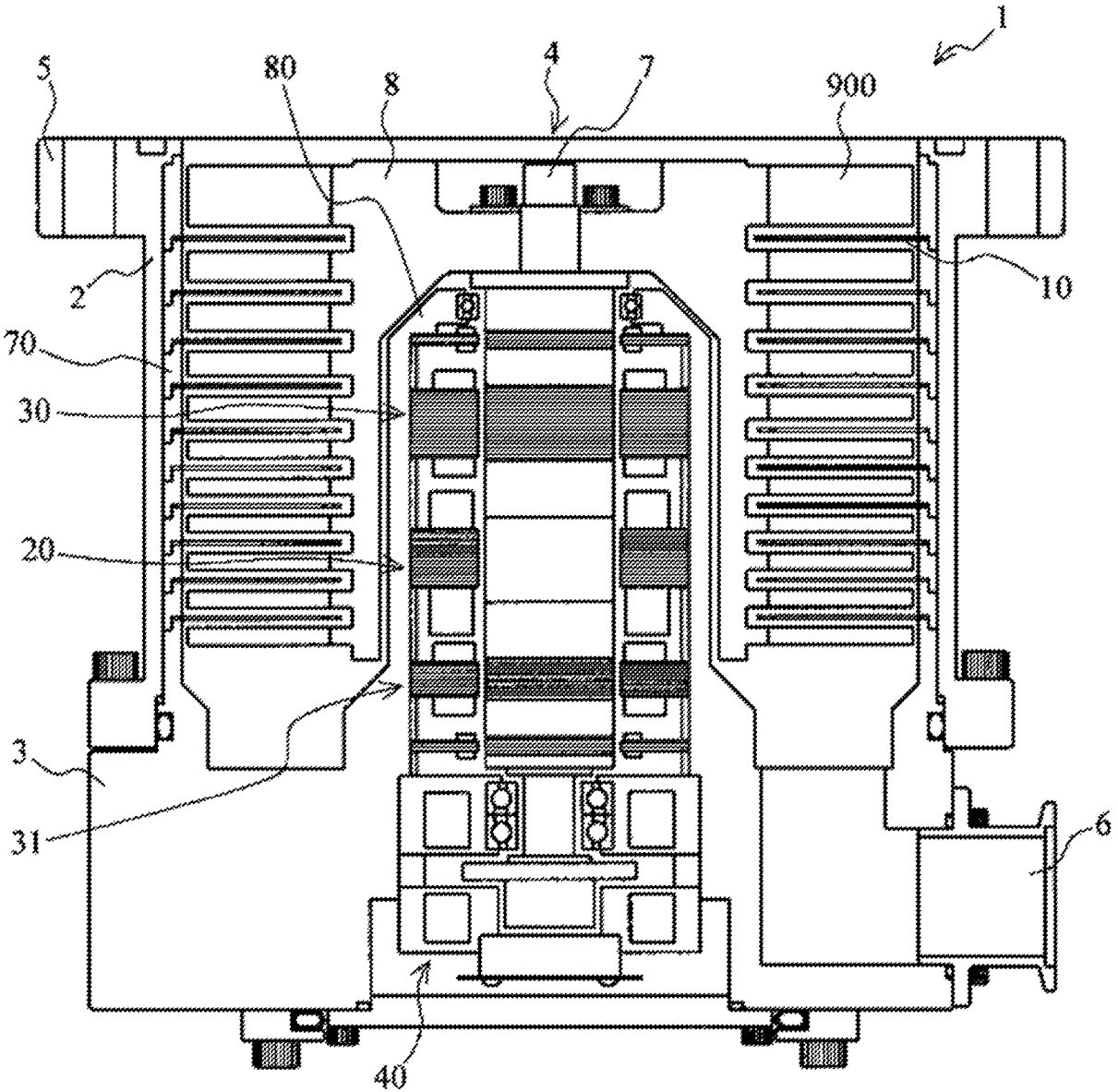
FIG. 1 is a diagram showing an example of a schematic configuration of a vacuum pump according to an embodiment of the invention.

FIG. 1 is a diagram showing an example of a schematic configuration of a vacuum pump 1 according to the embodiment of the invention, the diagram showing a cross section of the vacuum pump 1 taken along the axial direction.

Note that, for the sake of convenience, the embodiment of the invention describes a direction of a diameter of each rotor blade as "radial (diameter/radius) direction" and a direction perpendicular to the direction of the diameter of each rotor blade as "axial direction."

A casing (outer cylinder) 2 configuring a housing of the vacuum pump 1 has a substantially cylindrical shape and constitutes a housing of the vacuum pump 1 together with a base 3 provided in a lower portion of the casing 2 (outlet port 6 side). A gas transfer mechanism, which is a structure bringing about an exhaust function of the vacuum pump 1, is accommodated in this housing.

In the embodiment, this gas transfer mechanism is mainly constituted by a rotor portion supported rotatably and a stator portion fixed to the housing.

Although not shown, a controller for controlling the operation of the vacuum pump 1 is connected to the outside of the housing of the vacuum pump 1 by a dedicated line.

An inlet port 4 for introducing gas into the vacuum pump 1 is formed at an end portion of the casing 2. A flange portion 5 protruding toward the outer periphery is formed on an end surface of the casing 2 at the inlet port 4 side.

The outlet port 6 for exhausting the gas from the vacuum pump 1 is formed in the base 3.

The rotor portion of the gas transfer mechanism includes a shaft 7 which is a rotating shaft, a rotor 8 disposed on the shaft 7, and a plurality of spiral plates 900 provided on the rotor 8.

Each of the spiral plates 900 is constituted by a spiral disc member that extend radially with respect to the axis of the shaft 7 so as to form a spiral flow path. The disc member has at least one slit formed along a horizontal direction with respect to the axis of the shaft 7.

Note that the spiral plates 900 may be formed integrally with the rotor 8 or disposed as separate parts.

A motor portion 20 for rotating the shaft 7 at high speeds is provided in the middle of the shaft 7 in the axial direction and enclosed in a stator column 80.

Radial magnetic bearing devices 30, 31 for supporting the shaft 7 in the radial direction in a non-contact manner are provided inside the stator column 80, at the inlet port 4 side and the outlet port 6 side respectively, with respect to the motor portion 20 of the shaft 7. An axial magnetic bearing device 40 for supporting the shaft 7 in the axial direction in a non-contact manner is provided at a lower end of the shaft 7.

The stator portion of the gas transfer mechanism is formed on an inner peripheral side of the housing (casing 2).

Stator discs 10, separated by cylindrical spacers 70, are disposed in a fixed manner in the stator portion.

The stator discs 10 are each a disc-shaped plate-like member extending radially so as to be perpendicular to the axis of the shaft 7. In the embodiment, the plurality of stator discs 10 are each formed into a circular shape by joining semicircular (incomplete circular) members together and are arranged in the axial direction so as to alternate with the spiral plates 900 at the inner peripheral side of the casing 2. Each of the stator discs 10 is provided with a hole portion 12 (FIG. 3A and FIG. 3B) which is a through-hole. A part of each stator disc 10 other than the hole portion 12 is referred to as a solid portion 11 (FIG. 3A and FIG. 3B).

An arbitrary number of stator discs 10 and/or spiral plates 900 necessary for fulfilling discharge performance (exhaust performance) required for the vacuum pump 1 may be provided.

The spacers 70 are each a cylindrical fixed member, and the stator discs 10 in the respective stages are fixed, separated from each other by the spacers 70.

With this configuration, the vacuum pump 1 performs vacuum exhaust processing in a vacuum chamber (not shown) disposed in the vacuum pump 1.

The spiral plates 900 disposed in the foregoing vacuum pump 1 are now described with reference to FIG. 2.

Figure 2:
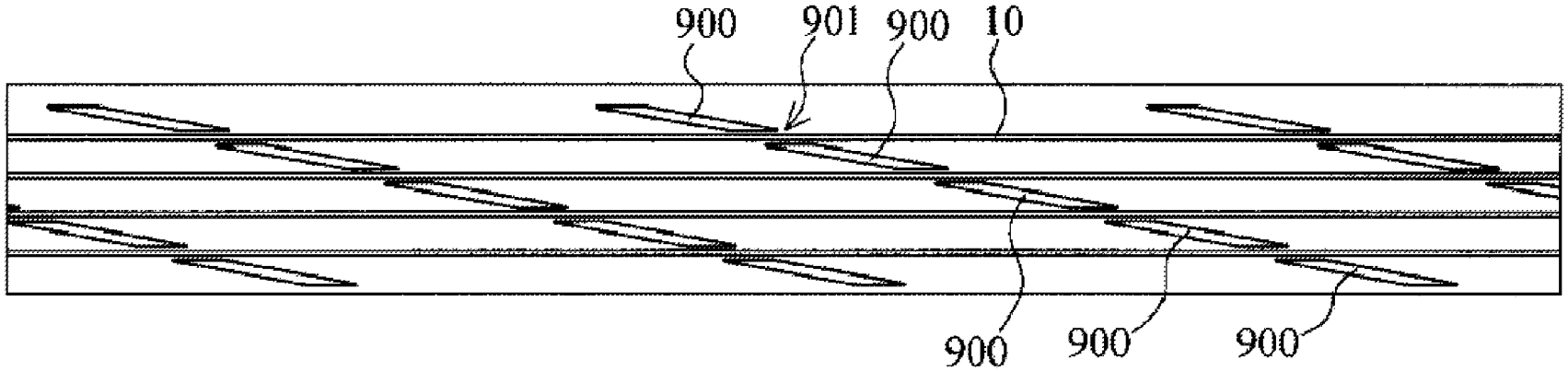
FIG. 2 is a partial schematic diagram of the vacuum pump for explaining spiral plates according to the embodiment of the invention.
Figure 3:
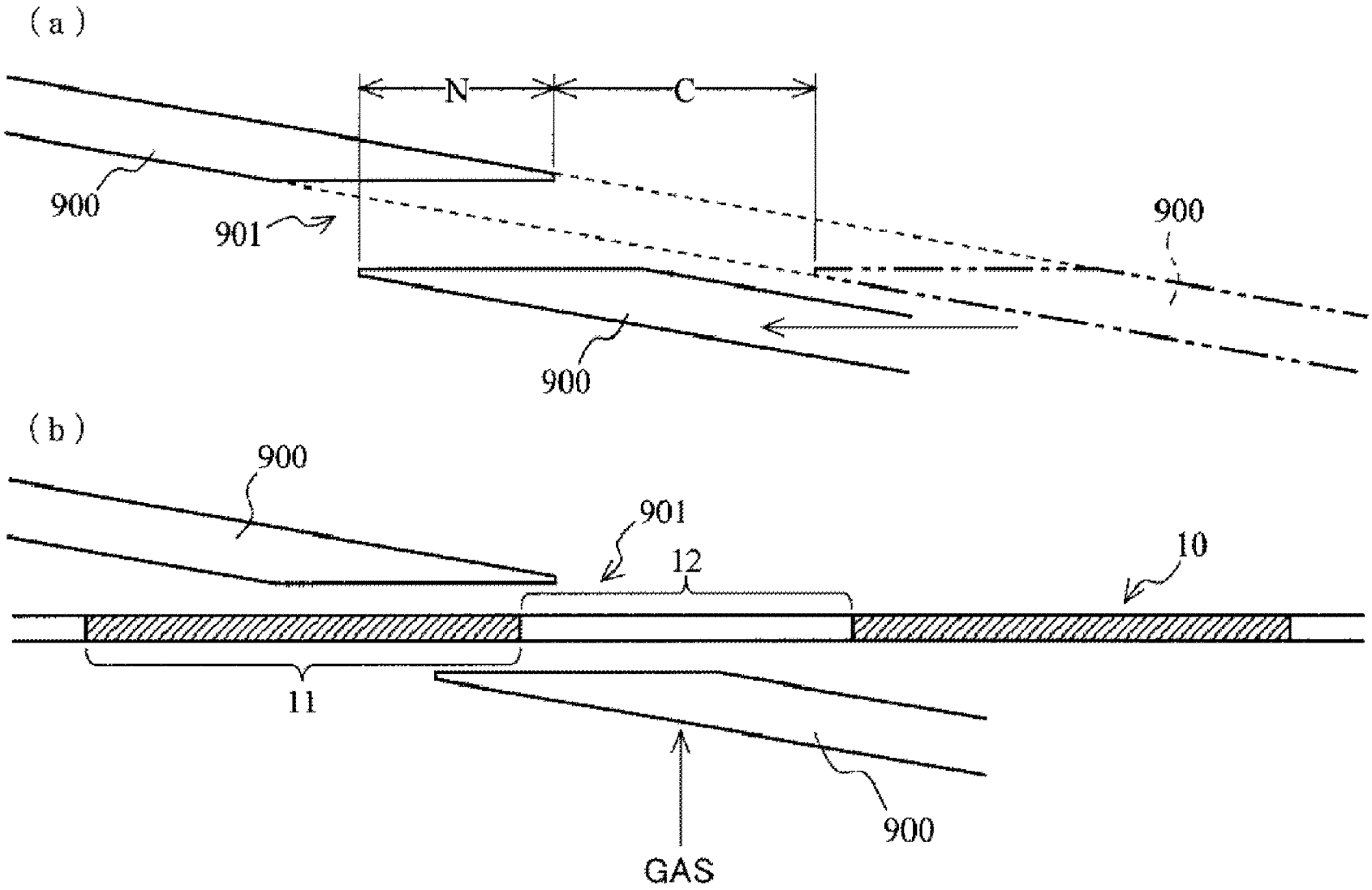
FIG. 3A and FIG. 3B are each an enlarged schematic diagram for explaining the spiral plates according to the embodiment of the invention.
Figure 4:
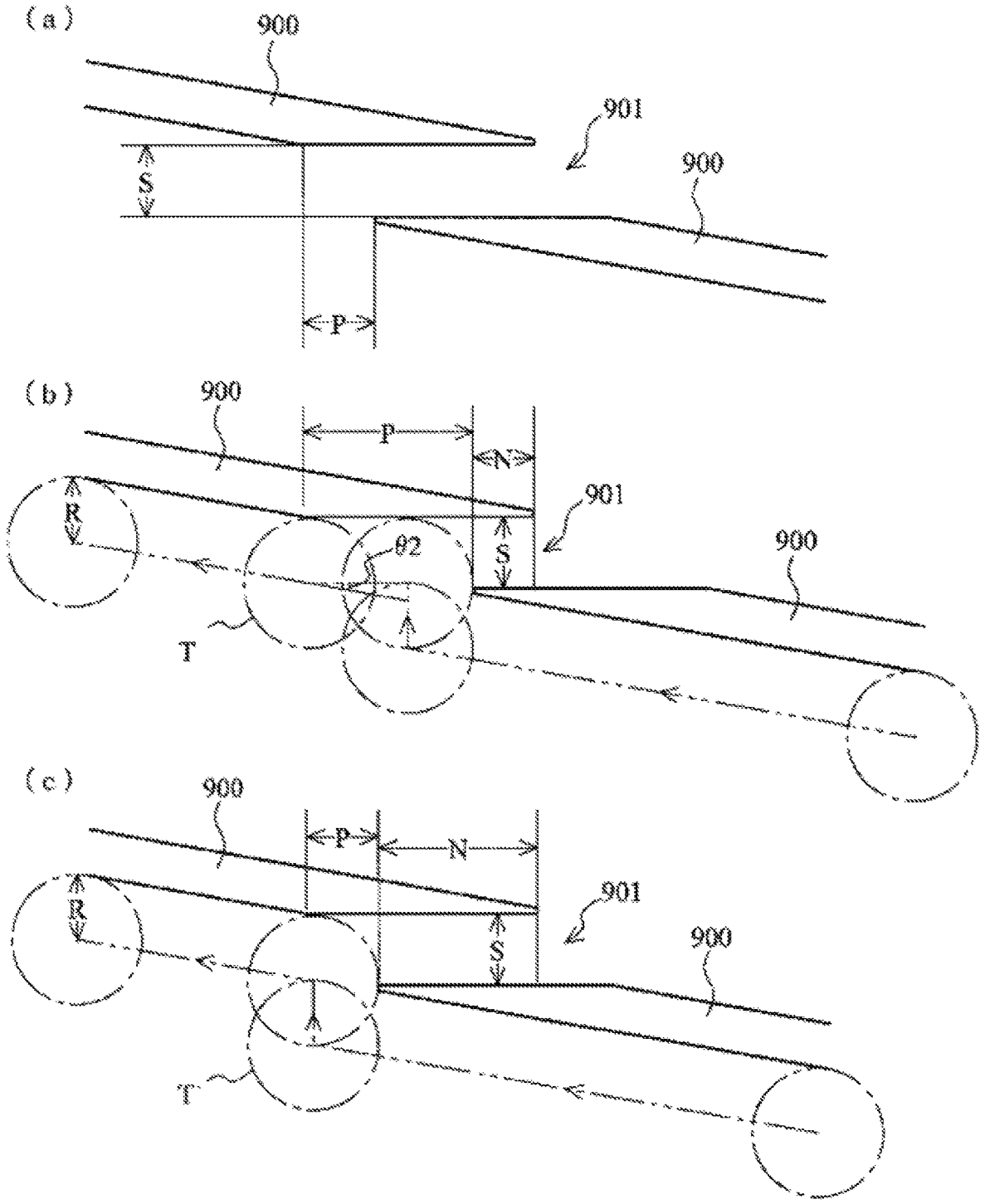
FIG. 4A to FIG. 4C are each an enlarged schematic diagram for explaining the spiral plates according to the embodiment of the invention.
Figure 5:
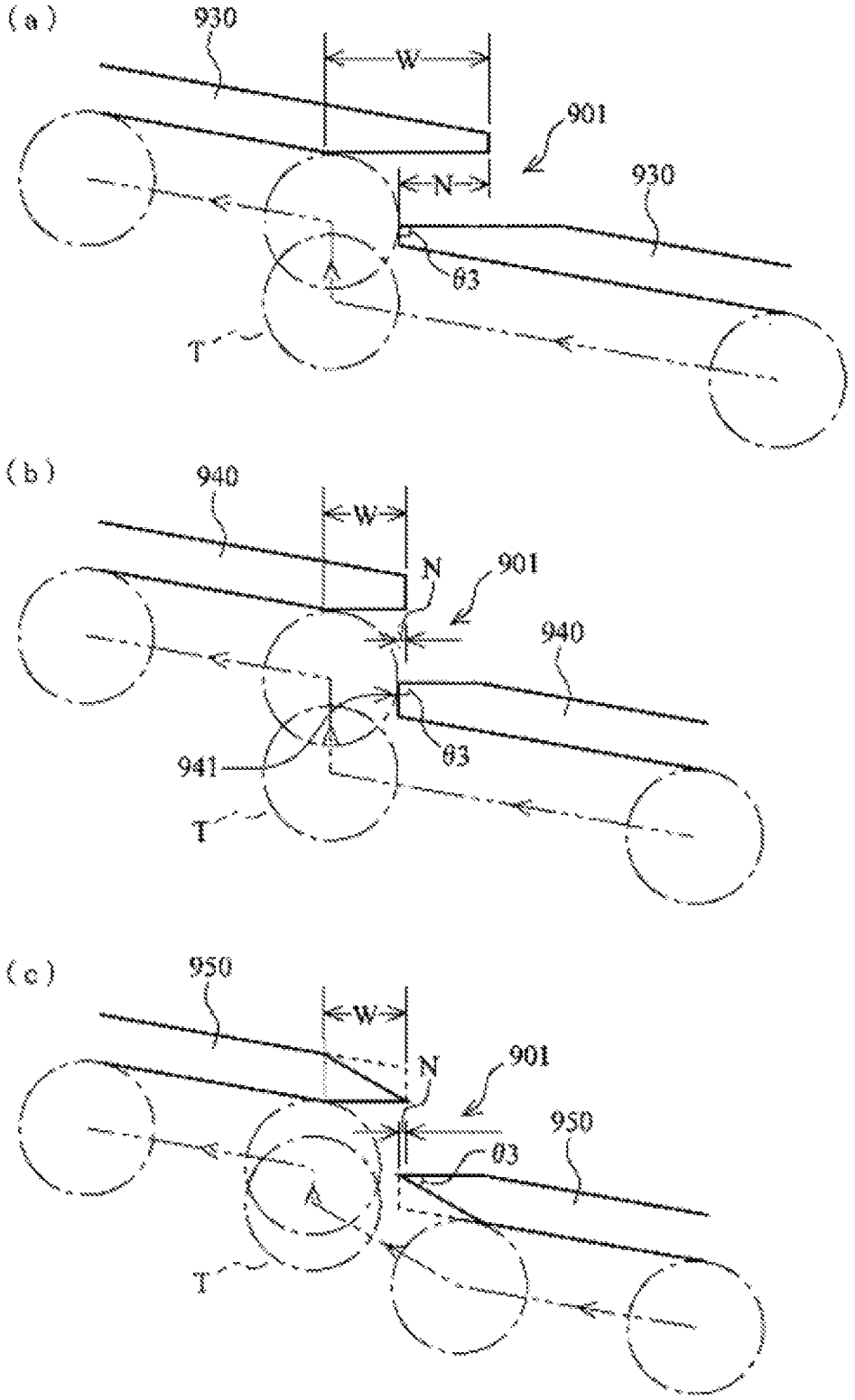
FIG. 5A to FIG. 5C are each an enlarged schematic diagram for explaining the spiral plates according to the embodiment (modification) of the invention.
Figure 6:
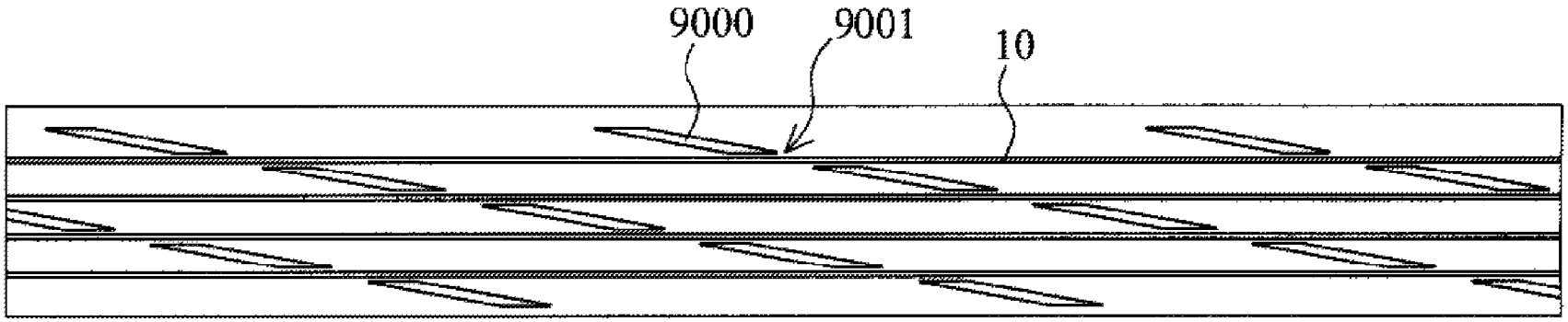
FIG. 6 is a schematic diagram for explaining the prior art.
Figure 7:
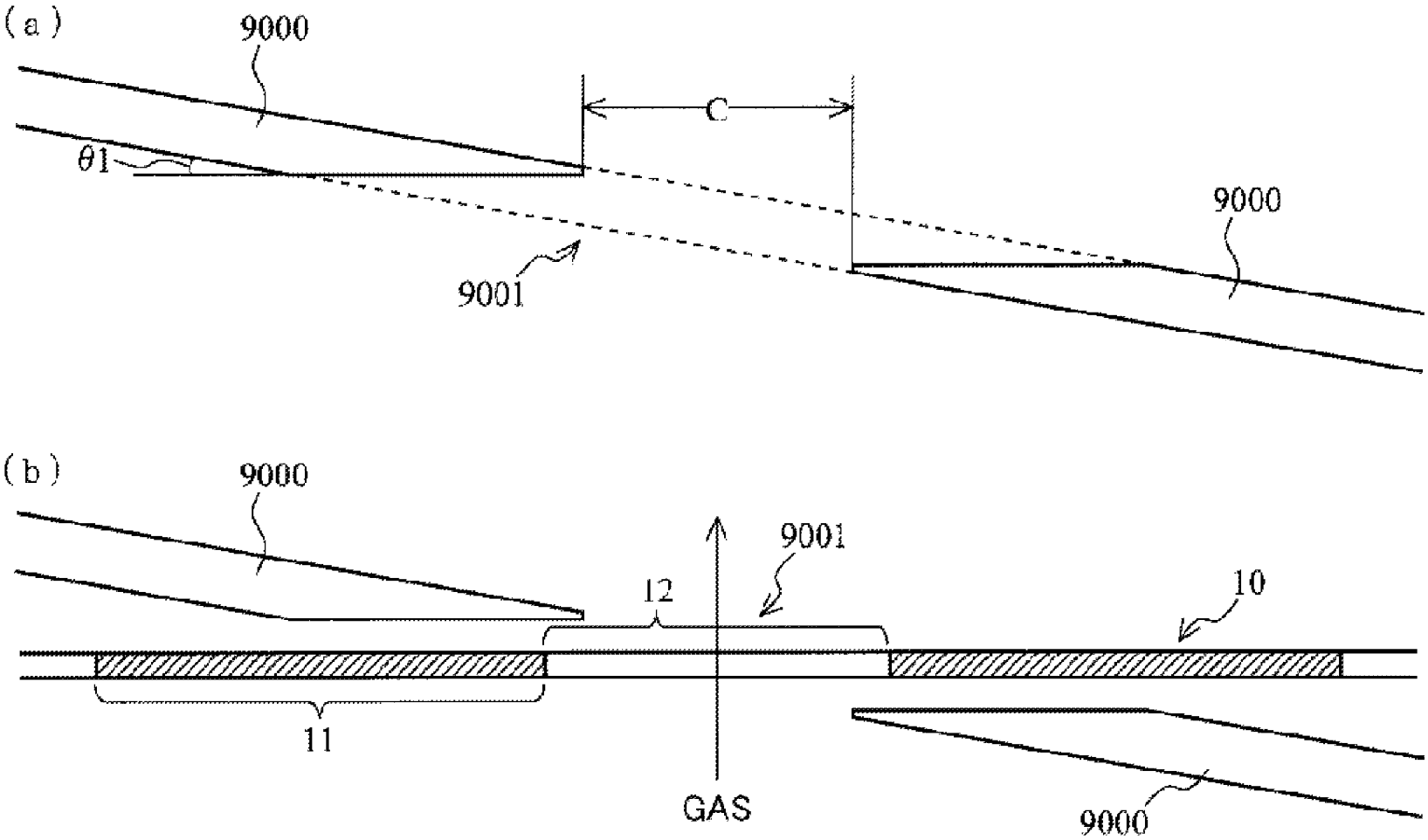
FIG. 7A and FIG. 7B are each a schematic diagram for explaining the prior art.

FIG. 2 is a schematic diagram showing the spiral plates 900 and the stator discs 10 of the vacuum pump 1, explaining the spiral plates 900 according to the embodiment.

FIG. 3A and FIG. 3B are each a schematic diagram for explaining the spiral plates 900 according to the embodiment, showing an enlargement of the vicinity of a slit 901 shown in FIG. 2.

As shown in FIG. 2, in the embodiment, a spiral plate 900 on the downstream side of the slit 901 is shifted in a direction in which the size of the slit 901 is reduced, to configure each spiral plate 900.

More specifically, as shown in FIG. 3A, the spiral plate 900 on the downstream side of the slit 901 is not disposed on an extended line (dotted lines shown in the diagram) of a spiral plate 900 on the upstream side of the slit 901, but is shifted (moved/disposed offset) in a direction in which the size of a gap C is reduced, i.e., in a direction in which the spiral plate 900 on the downstream side of the slit 901 overlaps the spiral plate 900 on the upstream side of the slit 901, as shown by the left arrow in FIG. 3A, to configure each spiral plate 900.

For reference, the position of the spiral plate 900 shown by the two-dot chain line in FIG. 3A is the position obtained when the downstream spiral plate 900 is disposed on the extended line of the spiral plate 900 on the upstream side of the slit 901 (prior art).

More preferably, as shown in FIG. 3A, in addition to reducing the size of the gap C, the distance by which the downstream spiral plate 900 moves toward the upstream spiral plate 900 may be increased to form "overlapping part N." More specifically, the downstream spiral plate 900 may be moved (shifted/disposed offset) toward the upstream spiral plate 900 until the "overlapping part N" is formed where the upstream spiral plate 900 and the downstream spiral plate 900 overlap each other in such a manner that the slit disappears (becomes invisible) when these spiral plates 900 on the upstream side and the downstream side are projected on each other in the axial direction. In other words, in the embodiment, the upstream spiral plate 900 and the downstream spiral plate 900 that are close to each other are opposed to each other in the axial direction, with a predetermined clearance (the slit 901) therebetween.

According to this configuration, as shown in FIG. 3B, by disposing, in the slit 901 between the spiral plates 900, a stator disc 10 having the hole portion 12 which is a through-hole and the solid portion 11 outside the hole portion 12, the gas can be prevented from flowing backward through the spiral plates 900 (gap C/slit 901) and the stator disc 10 (hole portion 12).

In the vacuum pump 1 with the spiral plates 900 according to the embodiment, the foregoing configuration of the spiral plates 900 can prevent the gas from flowing backward through the slit 901 between the spiral plates 900, because the slit 901 (the cap C) between the spiral plates 900 becomes small or disappears completely when the spiral plates 900 are projected in the axial direction. As a result, the vacuum pump 1 having excellent exhaust performance can be realized.

The shape of the spiral plates 900 and a method for machining (manufacturing) the spiral plates 900 are described next in further detail.

FIG. 4A to FIG. 4C are each an enlarged schematic diagram for explaining each spiral plate 900 according to the embodiment.

First, as shown in FIG. 4A, the upstream spiral plate 900 and the downstream spiral plate 900 according to the embodiment are opposed to (facing) each other in the axial direction with a slit width S therebetween, and a phase difference P is present between the upstream spiral plate 900 and the downstream spiral plate 900.

A relationship between the phase difference P and an end mill used for scraping each spiral plate 900 (referred to as "machining end mill" below) is now described hereinafter.

As a tool for the cutting processing for scraping the spiral plates 900, the embodiment describes a machining end mill used for the purpose of cutting with a side blade and gradually scraping out a hole in a direction perpendicular to the axis. Use of a machining end mill having a radius R (approximately 5 mm) is described as an example.

In the embodiment, the machining end mill is used to have a smooth finish for end surfaces (end portions) of the spiral plates 900 where the slit 901 is formed.

In FIGS. 4B and 4C, each of the chain lines shows a trajectory T of the machining end mill when the machining end mill scrapes the spiral plates 900, and the two-dot chain line shows a direction in which the machining end mill moves (central trajectory). This central trajectory also represents a moving path (machining path) required for machining the spiral plates 900 using the machining end mill.

FIG. 4B shows the spiral plates 900 having a large phase difference P therebetween (i.e., a projected area of the overlapping part N is small) among the spiral plates 900 described above.

In the embodiment, first, an inclined surface of the downstream spiral plate 900 is machined up to the position of the slit 901 by the machining end mill.

Next, at the position of the slit 901, the machining end mill is lifted up toward the upstream spiral plate 900. In so doing, a tip of the downstream spiral plate 900 is scraped with a right-side surface of the machining end mill, to form a chamfer (edge). Thereafter, an inclined surface of the upstream spiral plates 900 is machined.

Transitioning from chamfering the downstream spiral plate 900 to machining the inclined surface of the upstream spiral plate 900 in a continuous manner can be performed efficiently if the position where chamfering of the downstream spiral plate 900 ends and the position where machining of the inclined surface of the upstream spiral plate 900 begins are close to each other.

In the configuration shown in FIG. 4B, however, because the position where chamfering of the downstream spiral plate 900 ends and the position where machining of the inclined surface of the upstream spiral plate 900 begins are separated from each other, the position where chamfering of the downstream spiral plate 900 ends needs to be moved to the position where machining of the inclined surface of the upstream spiral plate 900 begins.

Therefore, when transitioning from chamfering the downstream spiral plate 900 to machining the inclined surface of the upstream spiral plate 900 in a continuous manner, the following configuration (FIG. 4C) may be employed in which the position where machining of the inclined surface of the upstream spiral plate 900 begins is aligned.

FIG. 4C shows the spiral plates 900 having the smallest possible phase difference P therebetween (i.e., the projected area of the overlapping part N is made as large as possible) among the spiral plates 900 described above.

As shown in FIG. 4C, when cutting (scraping) the spiral plates 900, it is desirable that the spiral plates 900 be designed on the basis of at least one of the followings (1) and (2):

(1) The radius R of the machining end mill is smaller than the slit width S of the slit 901 between the spiral plates 900 (R<S); and (2) The radius R of the machining end mill is smaller than the phase difference P between the upstream spiral plate 900 and the downstream spiral plate 900 (R<P).

According to this configuration, because the position where machining of the inclined surface of the downstream spiral plate 900 ends and the machining end mill is lifted up matches the position where machining of the inclined surface of the upstream spiral plate 900 begins, the position where machining of the inclined surface of the downstream spiral plate 900 ends and the machining end mill is lifted up does not need to be moved to the machining position.

Note that the larger the radius R of the machining end mill, the easier the machining process.

The slit width S between the spiral plates 900 and the phase difference P may be set to be equivalent or approximately equivalent to each other and the radius R of the machining end mill may be set to be smaller than the slit width S and the phase difference P that are approximately equivalent to each other (S=P<R).

According to this configuration, the path can be shortened by eliminating machining paths of the machining end mill for manufacturing the spiral plates 900, thereby forming the spiral plates 900 seamlessly (integrally). In addition, the possibility of formation of burrs in the spiral plates 900 can be reduced.

Consequently, the cost and labor required for manufacturing the spiral plates 900 can be reduced; the productivity can be improved.

A configuration example in which the chamfers of the spiral plates 900 have acute angles is described next as a modification of the foregoing embodiment.

FIG. 5A to FIG. 5C are each an enlarged schematic diagram for explaining spiral plates 930 (940, 950) according to the modification of the embodiment.

As shown in FIG. 5A, W represents the width of a horizontal part (horizontal surface) formed in each of an upstream spiral plate 930 and a downstream spiral plate 930.

In the width W of each horizontal surface, N represents the width of the parts of the upstream spiral plates 930 and the downstream spiral plate 930 that are opposed to each other with a predetermined gap therebetween (overlapping part N).

The angle of a chamfer formed on each spiral plate 930 is referred to as a chamfer angle θ3.

FIG. 5A shows the spiral plates 930 that are chamfered to have a chamfer angle θ3 of 90 degrees. More specifically, of the end portions of the spiral plates 930, between which the slit 901 is formed, the end portion where the acute angle (acute angle portion) is formed is subjected to chamfering.

Chamfering in this manner can prevent the formation of burrs in the slit 901.

A relationship between the width W of each horizontal surface and the overlapping part N is now described.

As shown in FIG. 5B, in order to reduce friction loss between the horizontal surface of each spiral plate 930 and the stator disc (stator disc 10; FIG. 2) disposed in the slit 901 between the spiral plates 930, the spiral plates 940 may be configured to reduce the width W of each of the horizontal surfaces thereof and the overlapping part N.

Reducing the width W of each horizontal surface while keeping the 90-degree chamfer angle θ3 of the chamfered part of each spiral plate 940 as shown in FIG. 5B might lead to an increase in the width of each chamfered surface 941, making it difficult for the gas to flow smoothly. Such effect is significant especially if the spiral plates 940 are thick.

Therefore, as the spiral plates 950 in FIG. 5C shows, the chamfer angle θ3 may be reduced, that is, the chamfer angle θ3 that is acute may be formed, to the extent that the overlapping part N between the upstream spiral plate 950 and the downstream spiral plate 950 does not disappear. In this example, the chamfer angle θ3 is, for example, 30 degrees.

Alternatively, although not shown, each chamfered surface 941 may be formed in a curved shape. Forming each chamfered surface 941 in a curved shape can allow the gas to flow more smoothly.

According to the foregoing configuration, in the modification, the vacuum pump 1 having the spiral plates 930 (940, 950) can prevent the formation of burrs in the slit 901. The foregoing configuration can also reduce friction loss occurring between the horizontal surface of each spiral plate 930 (940, 950) and the stator disc 10, making the gas flow smooth.

Consequently, the exhaust performance of the vacuum pump 1 can be enhanced.

At least one downstream spiral plate 900 (930, 940, 950) of the spiral plates 900 (930, 940, 950) disposed in the vacuum pump 1 may have the foregoing configuration of each spiral plate 900 (930, 940, 950) on the downstream side of the slit 901.

The embodiment of the invention and the modification thereof may be combined as needed.

Various modifications can be made to the invention without departing from the spirit of the invention, and it goes without saying that the invention extends to such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a housing in which an inlet port and an outlet port are formed;

a rotating shaft enclosed in the housing and supported rotatably;

spiral plates provided with at least one slit and disposed in a spiral form on an outer peripheral surface of the rotating shaft or of a rotating cylinder disposed on the rotating shaft;

a stator disc disposed in the slit of each of the spiral plates, with a predetermined space from the slit, and having a hole portion penetrating the stator disc;

a spacer for fixing the stator disc; and a vacuum exhaust mechanism for transferring gas sucked from the inlet port to the outlet port by an interaction between the spiral plates and the stator disc, wherein at least one of the spiral plates on a downstream side of the slit is disposed offset from an extended line of at least one of the spiral plates on an upstream side of the slit in a direction in which the spiral plate on the downstream side of the slit overlaps the spiral plate on the upstream side of the slit.

2. The vacuum pump according to claim 1, wherein the spiral plate on the upstream side and the spiral plate on the downstream side overlap each other with a predetermined gap therebetween in at least one of a plurality of the slits, and the slit becomes invisible in a direction of the rotating shaft.

3. The vacuum pump according to claim 1, wherein in at least one of a plurality of the slits, a phase difference between the spiral plate on the upstream side and the spiral plate on the downstream side is equivalent to a width of the slit.

4. The vacuum pump according to claim 1, wherein at least one of acute angle portions formed by dividing the spiral plates by the slit is subjected to chamfering.

5. The vacuum pump according to claim 4, wherein the chamfering is performed within a width of a horizontal plane formed by dividing the spiral plates by the slit, and the chamfer has an acute angle.

6. The vacuum pump according to claim 1, comprising the spiral plates cut by a cutting tool having a radius smaller than at least one of a width of the slit of each of the spiral plates and a phase difference between the spiral plate on the upstream side and the spiral plate on the downstream side.

7. A spiral plate which is provided in the vacuum pump according to claim 1.

8. A rotating cylinder, comprising the spiral plate according to claim 7.

9. A method for manufacturing the spiral plate according to claim 7, the method comprising:

a first step of cutting an inclined surface of the spiral plate on the downstream side;

a second step of forming the chamfer on the spiral plate on the downstream side; and a third step of cutting an inclined surface of the spiral plate on the upstream side.

10. The vacuum pump according to claim 2, wherein in at least one of a plurality of the slits, a phase difference between the spiral plate on the upstream side and the spiral plate on the downstream side is equivalent to a width of the slit.

11. The vacuum pump according to claim 2, wherein at least one of acute angle portions formed by dividing the spiral plates by the slit is subjected to chamfering.

12. The vacuum pump according to claim 3, wherein at least one of acute angle portions formed by dividing the spiral plates by the slit is subjected to chamfering.

13. The vacuum pump according to claim 2, comprising the spiral plates cut by a cutting tool having a radius smaller than at least one of a width of the slit of each of the spiral plates and a phase difference between the spiral plate on the upstream side and the spiral plate on the downstream side.

14. The vacuum pump according to claim 3, comprising the spiral plates cut by a cutting tool having a radius smaller than at least one of a width of the slit of each of the spiral plates and a phase difference between the spiral plate on the upstream side and the spiral plate on the downstream side.

15. The vacuum pump according to claim 4, comprising the spiral plates cut by a cutting tool having a radius smaller than at least one of a width of the slit of each of the spiral plates and a phase difference between the spiral plate on the upstream side and the spiral plate on the downstream side.

* * * * *